US010309623B2

(12) United States Patent
Nanni

(10) Patent No.: US 10,309,623 B2
(45) Date of Patent: Jun. 4, 2019

(54) LAMP HAVING LED MODULE FIXING ELEMENT WITH BAYONET MOUNT STRUCTURE, AND ADAPTER STRUCTURE

(71) Applicant: VIABIZZUNO S.r.l., Bentivoglio (IT)

(72) Inventor: Mario Nanni, Bologna (IT)

(73) Assignee: VIABIZZUNO S.R.L., Bentivoglio (Bologna) (IT)

( * ) Notice: Subject to any disclaimer, the term of this patent is extended or adjusted under 35 U.S.C. 154(b) by 23 days.

(21) Appl. No.: 15/543,433

(22) PCT Filed: Jan. 21, 2016

(86) PCT No.: PCT/IB2016/050290
§ 371 (c)(1),
(2) Date: Jul. 13, 2017

(87) PCT Pub. No.: WO2016/116883
PCT Pub. Date: Jul. 28, 2016

(65) Prior Publication Data

US 2018/0003365 A1 Jan. 4, 2018

(30) Foreign Application Priority Data

Jan. 23, 2015 (IT) ..... BO2015A0022

(51) Int. Cl.
*F21V 19/00* (2006.01)
*F21V 17/14* (2006.01)
(Continued)

(52) U.S. Cl.
CPC ..... *F21V 19/003* (2013.01); *F21V 17/14* (2013.01); *F21V 19/0055* (2013.01);
(Continued)

(58) Field of Classification Search
CPC ..... F21V 17/14; F21V 17/104; F21V 17/18; F21V 19/003; F21V 19/0035; F21V 19/0045
See application file for complete search history.

(56) References Cited

U.S. PATENT DOCUMENTS 6,541,800 B2 * 4/2003 Barnett ..... F21L 4/027 257/98
7,281,818 B2 * 10/2007 You ..... F21V 7/0083 257/88
(Continued)

FOREIGN PATENT DOCUMENTS

CN 102639933 A 8/2012
CN 104204662 A 12/2014
(Continued)

OTHER PUBLICATIONS

International Search Report dated Jun. 13, 2016 for counterpart PCT Application No. PCT/IB32016/050290.
(Continued)

*Primary Examiner* — Ismael Negron
(74) *Attorney, Agent, or Firm* — Shuttleworth & Ingersoll, PLC; Timothy J. Klima

(57) ABSTRACT

A lamp structure includes an a LED light source, a heat sink element having a flat surface for supporting the LED light source and a central axis perpendicular to the flat surface, a fixing element for pressing the light source against the flat supporting surface, means for removably fastening the fixing element to the heat sink element, and an adapter element providid between the LED light source and the fixing element for actively coupling one of a plurality of different LED light sources to the fixing element. A method of replacing an LED light source in a lamp structure is also provided.

4 Claims, 7 Drawing Sheets

(51) Int. Cl.

| | |
|---|---|
| ***F21V 19/04*** | (2006.01) |
| ***F21V 29/503*** | (2015.01) |
| *F21V 7/06* | (2006.01) |
| *F21Y 115/10* | (2016.01) |
| *F21V 7/04* | (2006.01) |

(52) U.S. Cl.
CPC ..... *F21V 19/045* (2013.01); *F21V 29/503* (2015.01); *F21V 7/041* (2013.01); *F21V 7/06* (2013.01); *F21Y 2115/10* (2016.08)

(56) References Cited

U.S. PATENT DOCUMENTS

| | | | | |
|---|---|---|---|---|
| 7,708,452 | B2 * | 5/2010 | Maxik | H05K 1/189 362/650 |
| 7,988,336 | B1 * | 8/2011 | Harbers | F21K 9/00 362/294 |
| 8,033,687 | B2 * | 10/2011 | Wang | F21V 29/004 362/267 |
| 8,500,299 | B2 * | 8/2013 | Speidel | F21V 11/00 362/235 |
| 8,517,576 | B2 * | 8/2013 | Yang | F21V 3/02 313/46 |
| 8,684,569 | B2 * | 4/2014 | Pickard | F21S 8/026 362/147 |
| 8,702,274 | B2 * | 4/2014 | Breidenassel | F21V 17/12 362/249.01 |
| 8,845,141 | B2 * | 9/2014 | Wronski | F21V 7/22 362/249.02 |
| 9,091,399 | B2 * | 7/2015 | Farmer | E04B 1/34321 |
| 9,249,955 | B2 * | 2/2016 | Schroll | F21V 29/507 |
| 9,562,548 | B2 | 2/2017 | Breidenassel et al. | |
| 2008/0298075 | A1 * | 12/2008 | Liao | F21V 29/004 362/373 |
| 2011/0007515 | A1 | 1/2011 | Farmer | |
| 2011/0019409 | A1 | 1/2011 | Wronski | |
| 2015/0070918 | A1 | 3/2015 | Stucchi | |

FOREIGN PATENT DOCUMENTS

| | | | |
|---|---|---|---|
| DE | 102009047493 | A1 | 6/2011 |
| DE | 102010031312 | A1 | 1/2012 |
| DE | 102011004683 | A1 | 8/2012 |
| EP | 2423572 | A2 | 2/2012 |
| WO | 2012117310 | A1 | 9/2012 |
| WO | 2013182223 | A1 | 12/2013 |

OTHER PUBLICATIONS

Partial European Search Report dated Mar. 15, 2016 for counterpart European Patent Application No. EP16152255.
Partial European Search Report dated Mar. 31, 2016 for counterpart European Patent Applicaiton No. EP16152255.
European Search Report dated Mar. 31, 2018 for counterpart European Patent Application No. EP16152255.
Italian Search Report dated Oct. 7, 2015 for counterpart Italian patent Application No. ITBO20150022.
Chinese Office Action dated Feb. 28, 2019 from counterpart Chinese App No. 201680006619.0.

* cited by examiner

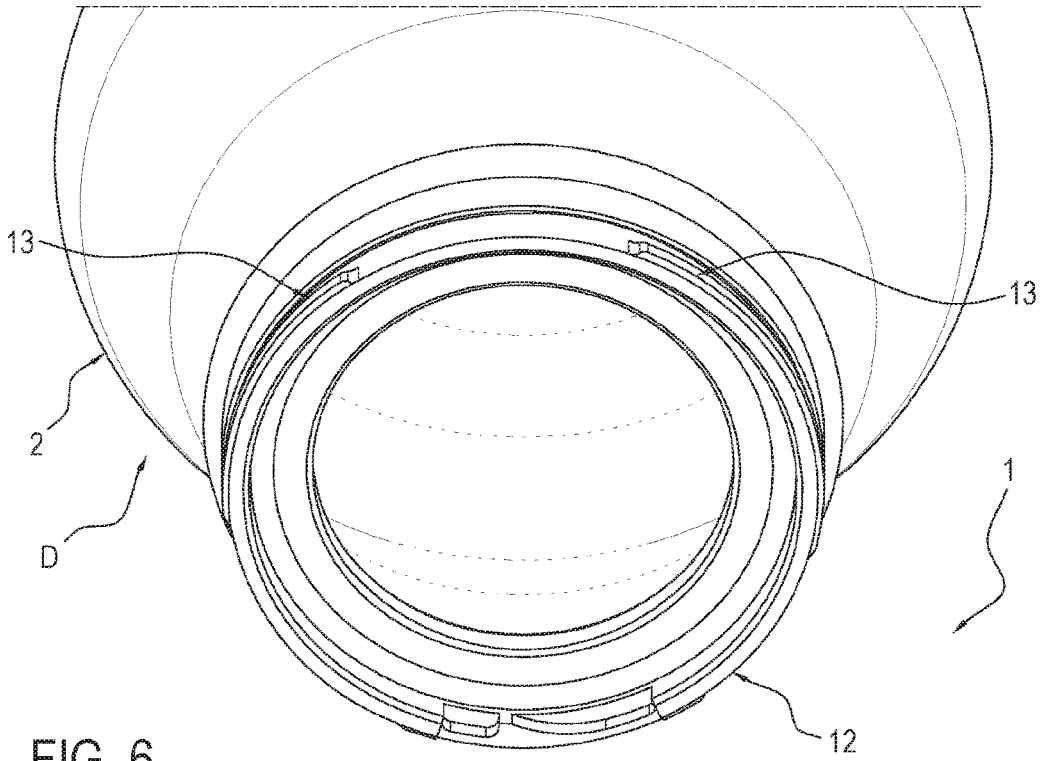
FIG. 6
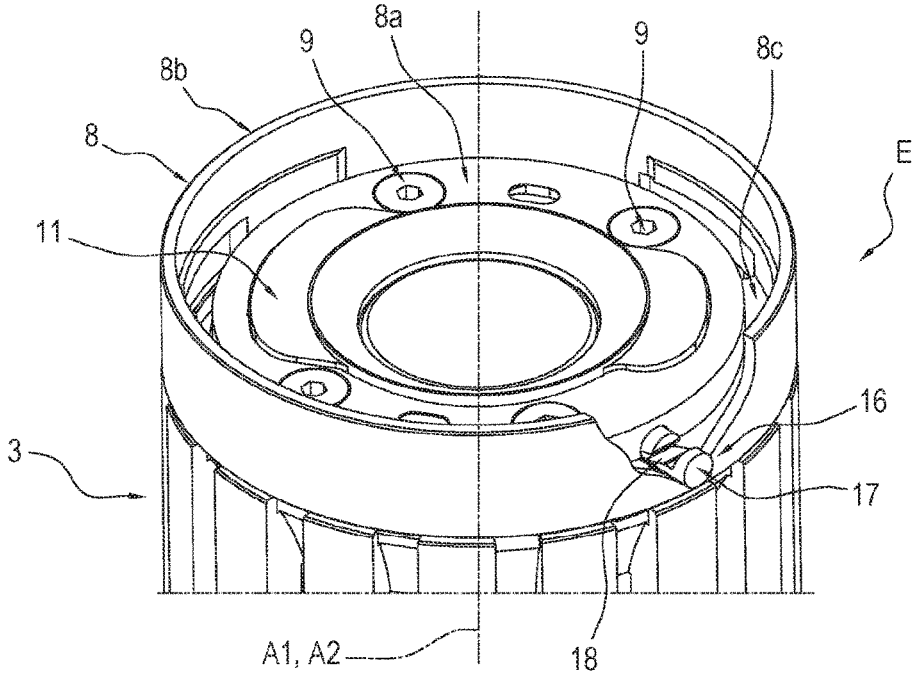

LAMP HAVING LED MODULE FIXING ELEMENT WITH BAYONET MOUNT STRUCTURE, AND ADAPTER STRUCTURE

This application is the National Phase of International Application PCT/IB2016/050290 filed Jan. 21, 2016 which designated the U.S. and that International Application was published under PCT Article 21(2) in English.

This application claims priority to Italian Application No. BO2015A000022 filed Jan. 23, 2015, which application is incorporated by reference herein.

TECHNICAL FIELD

This invention relates to a modular lamp structure.

More specifically, this invention relates to a modular lamp structure which uses light emitting diodes (LEDs).

More specifically, this invention relates to a LED of the type mounted on a plate or board, better known as SMD, the abbreviation for surface-mount device.

BACKGROUND ART

Over recent years, the use of LEDs in lighting systems has become increasingly widespread thanks to their numerous advantages over traditional incandescent, neon and halogen lamps.

Although the average price of LED light bulbs is higher than that of traditional light bulbs, their average life is decidedly longer, easily exceeding 50,000 hours.

Further, unlike incandescent light bulbs, which stop working all of a sudden when the filament breaks, the working life of an LED ends gradually, with appreciable but not excessive loss of light intensity, making it possible to plan substitution without running the risk of sudden complete loss of light.

The apparently inexorable spread of LED light bulbs is, however, almost certainly due to their energy efficiency: in effect, they are much more efficient than filament (or even halogen) light bulbs since much less energy is wasted in the form of infrared radiation and heat released to the environment compared to traditional light bulbs.

Manufacturers of light bulbs have therefore started producing LED light bulbs with standard connectors, making them suitable for installation in place of traditional light bulbs.

Owing to the constant growth of LED technology, however, industrial production is unable to keep up with new developments, not only on account of the investments required but also on account of the minimum required time for putting a new product into production.

In effect, the creation of new and increasingly higher performing LEDs renders the LED light bulbs present on the market rapidly obsolete.

This drawback in turn leads to a strongly felt problem in the field of lamp design, precisely because of the difficulty of predicting technical developments (not only in functional terms but also, and above all, in dimensional terms) of potentially usable LED bulbs.

In other words, when designing a lamp or luminaire, it is extremely difficult, for example, to predict the size of a better performing or more powerful LED bulb which might appear on the market as little as one year after the lamp or luminaire has been put into production.

Similarly, depending, for example, on the specific use planned for the lamp, it could require an LED lamp with equally particular features, sometimes depending on the presence of further elements such as filters, diffusers and other means for conditioning the light beam emitted by the lamp.

DISCLOSURE OF THE INVENTION

The aim of this invention is to provide an modular LED lamp structure capable of overcoming the drawbacks of the prior art and which is at once practical to use and simple to make.

A further aim of this invention is to provide a modular LED lamp structure which is versatile and easily adaptable to different requirements of the users.

BRIEF DESCRIPTION OF DRAWINGS

The technical features of the invention, with reference to the above aims, are clearly described in the claims below and its advantages are more apparent from the detailed description which follows, with reference to the accompanying drawings which illustrate a non-limiting embodiment of the invention by way of an example, and in which:

FIG. 6 is a schematic perspective view of a step of assembling an example embodiment of the modular LED lamp structure according to this invention;

DETAILED DESCRIPTION OF PREFERRED EMBODIMENTS OF THE INVENTION

As illustrated in FIG. 6, in a disassembled configuration, the numeral 1 denotes in its entirety a modular LED lamp structure made according to this invention.

The modular structure 1 according to this invention is designed to be integrated in simple or complex lighting systems, not illustrated, and equipped with parts and apparatuses which are able to support the structure.

With reference to FIG. 6, the modular structure 1 consists of a first part E comprising the electrical components for the generation of the light radiation and a second part D defined basically by the elements which contribute to the diffusion of the luminous radiation.

Purely by way of example, FIG. 6 illustrates a spherical diffuser element 2, advantageously made of glass.

Figure 1:
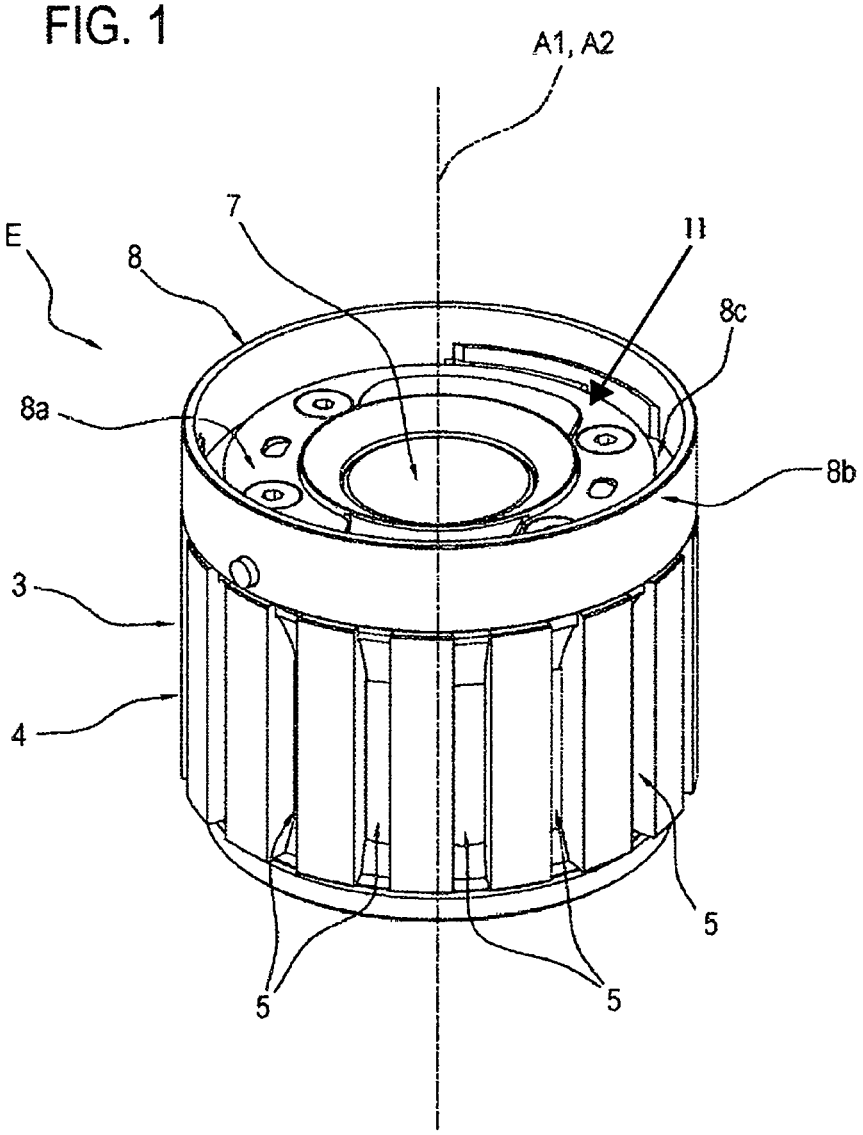
FIG. 1 is a schematic perspective view of a part of a preferred embodiment of the modular LED lamp structure according to this invention.
Figure 2:
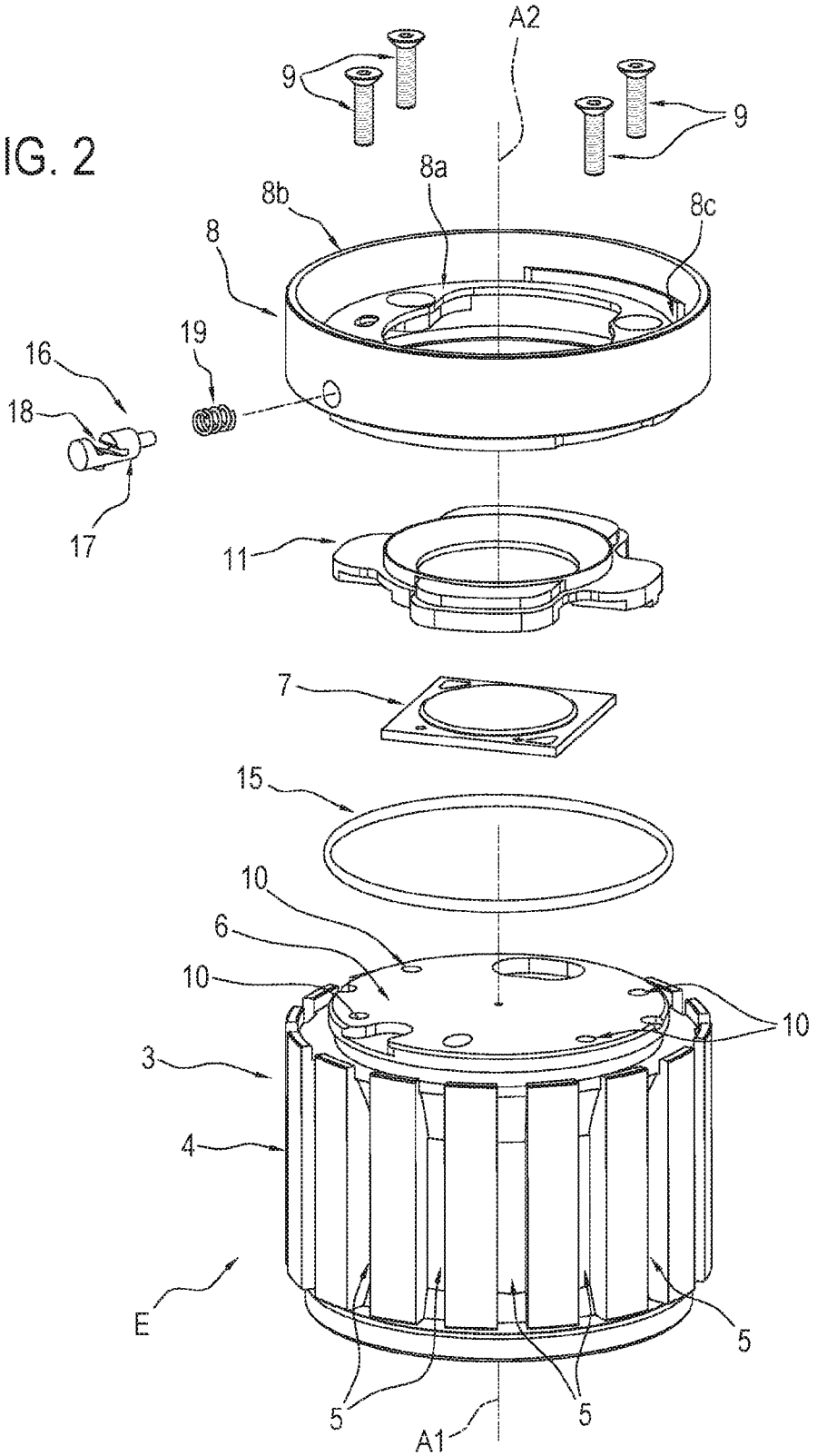
FIG. 2 is an exploded schematic view of the part of the modular structure of FIG. 1.
Figure 3:
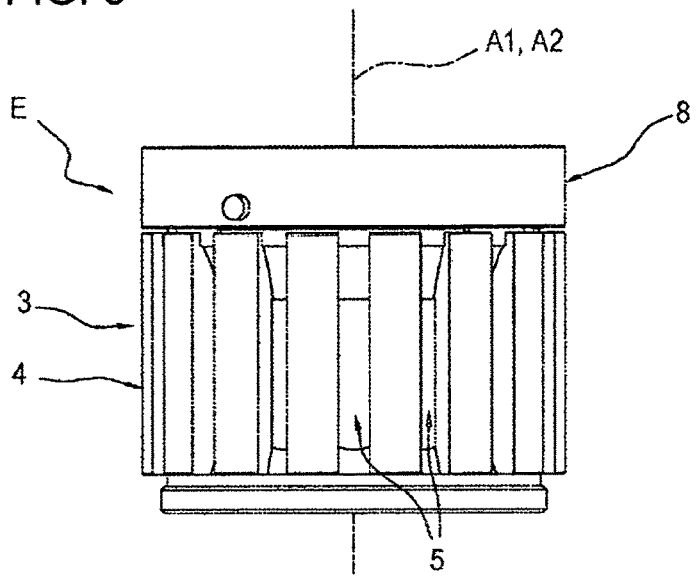
FIG. 3 is a schematic elevation view of the part of the modular structure of FIG. 1.

The above-mentioned first part E is illustrated in FIG. 1 and, in an exploded form in FIG. 2.

With reference to these drawings, the first part E comprises a heat sink element 3, containing inside electrical parts not illustrated.

The heat sink element 3 has an axially symmetric extension and has a central axis A1 and a cylindrical outer wall 4.

The outer cylindrical wall 4 has a plurality of openings 5 extending longitudinally parallel to the above-mentioned axis A1.

The openings 5 are designed to put inner portions, not illustrated, of the sink element 3 in communication with the outside environment and allowing a consequent flow of cooling air.

As illustrated in FIG. 2, the heat sink element 3 has a flat face 6, perpendicular to the above-mentioned central axis A1, on which an LED light source 7 is mounted.

The LED light source 7 is advantageously of the type mounted on a plate or board, better known as SMD, the abbreviation for surface-mount device.

With reference to FIGS. 1 to 5, the modular structure 1 comprises a mask(fixing element)8 for locking the light source 7 to the sink element 3.

The locking mask 8 is designed to press the light source 7 against the sink element 3, keeping it pressed against the above-mentioned flat face 6 of the sink element 3.

The fact of achieving an adequate contact between the light source 7 and the sink element 3 is advantageous from the point of view of an effective transmission of heat towards the sink element 3.

Only an efficient dissipation of the heat produced by the LED light source may in effect to guarantee a good the duration of the light source, that is, without a rapid decay of the of the quality and intensity of the light emitted.

The locking mask 8 is advantageously made of a metallic material.

The locking mask 8 is secured to the sink element 3 by means of four screws 9 designed to engage in respective threaded holes 10, made on the sink element 3 and protruding from the above-mentioned flat face 6.

The screws 9 define means for removably fastening the metal mask 8 to the sink element 3.

The screws 9 are advantageously of the anti-loosening type to prevent alternating thermal expansion from creating over time a lack of support of the LED light source 7 with respect to the flat face 6 of the sink element 3.

As clearly illustrated in FIG. 2, the lamp structure 1 comprises an adapter element 11 interposed between the light source 7 and the metal mask 8.

The adapter element 11 is of interchangeable type, to make the metal mask 8 compatible with LED lighting sources 7 of many shapes, different from each other.

The adapter element 11 is advantageously made of plastic material.

Preferably, the adapter element 11 is made of electrically insulating plastic material.

Figure 11:
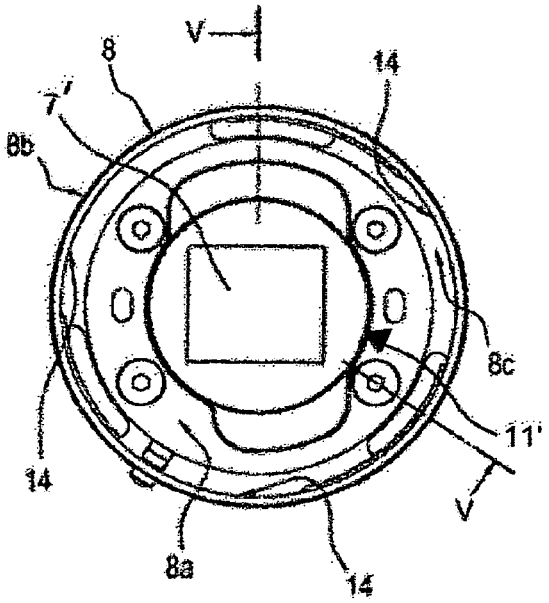
FIG. 11 shows an alternative of the modular structure of FIG. 1.

In other words, the adapter element 11, allows, as described in more detail below, the light source 7 mounted on the sink element 3 to be changed with sources which are different in shape and size, by modifying solely the adapter element 11, and not other parts of the modular structure 1. See FIG. 11 where the adapter element 11' is configured to correspond to a differently shaped (rectangular) and sized light source 7'. The embodiment of a suitable adapter for a different LED light source 7 is moreover particularly inexpensive since it is made of plastic material, also with the modern three-dimensional printers.

The metal locking mask 8 and the adapter element 11 have respective faces shaped to match designed to engage with each other to define a shape coupling.

Figure 4:
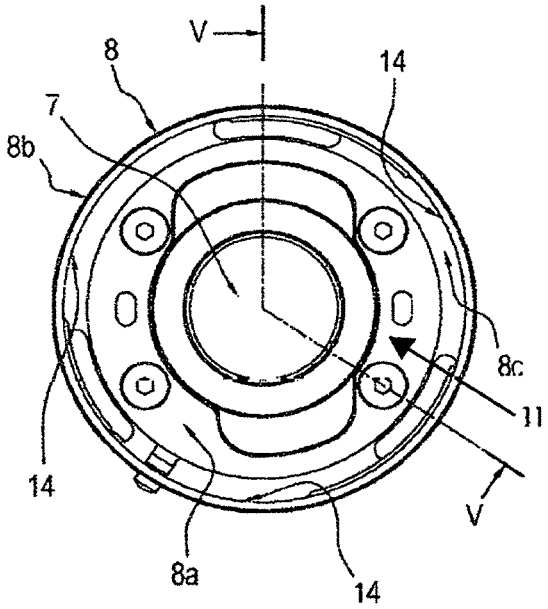
FIG. 4 is a schematic top plan view of the part of the modular structure of FIG. 1.

The shape defining this shape coupling, shown in FIG. 4 in the part distal relative to the sink element 3, has a profile which is asymmetrical so as to form a single possible angular coupling position relative to the central axis A1.

In other words, thanks to this asymmetrical profile, the coupling between the locking metal mask 8 and the adapter element 11 allows a single position, so as to simplify the assembly by the operator.

For the purposes of this specification, the term asymmetrical profile means any profile, if necessary also having an axis of symmetry, designed in any case to define a unique angular positioning between the two above-mentioned components.

Figure 5:
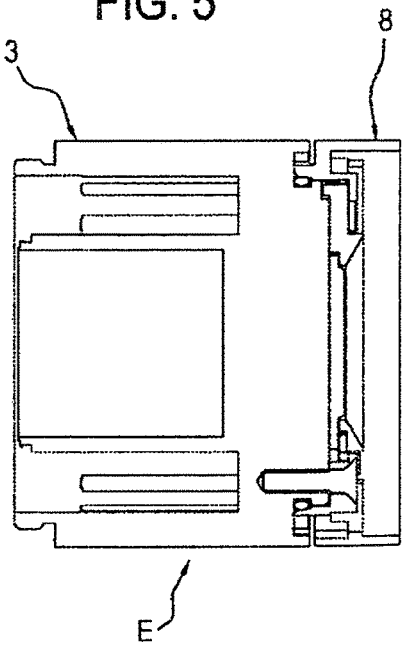
FIG. 5 is a cross section view through the line V-V of FIG. 4.

With particular reference to FIGS. 2, 5 and 6, the locking mask 8 comprises a central portion 8*a* for engagement with the adapter element 11, and an central cylindrical portion 8*b* which wraps around the outside of the central portion 8*a*.

The central portion 8*a* has a through opening designed to allow the passage of the light beam emitted by the LED source 7.

The outer cylindrical portion 8*b* extends according to a relative central axis A2 perpendicular to the flat supporting face 6 of the sink element 3 and substantially coincident with the central axis A1 of the latter.

The outer cylindrical portion 8*b* defines a wall facing the outside designed to contribute to the dissipation of the heat generated by the light source.

Experimentally, following simulations and laboratory tests, it has been noted how with regard to the dissipation of the heat generated by the LED light source 7 the contribution from the mask 8 is quantifiable in terms of a temperature of approximately 5° C.

In other words, in the tests performed, the presence of the mask 8, with its cylindrical portion 8*b*, has implied a lowering of the temperature of the lamp structure 1, by approximately 5° C.

As already partly described above, the modular LED lamp structure 1 according to this invention comprises a plurality of elements which contribute to the diffusion of the luminous radiation emitted by the LED source 7 and one of these elements, having the form of a spherical diffuser element 2, is illustrated by way of example in FIG. 6.

The elements which contribute to the diffusion of the luminous radiation emitted by the LED source 7, such as also the spherical diffuser element 2, define, for the modular lamp structure 1, respective means for conditioning the light beam.

With reference to FIG. 6, the spherical diffuser element 2 has an end portion 12, having an annular extension.

As shown in the FIG. 6, the metal locking mask 8 has an annular cavity 8*c* defined in the connection part between the above-mentioned central portion 8*a* and the outer cylindrical portion 8*b*.

This annular cavity 8*c*, suitably shaped to receive inside it the end portion 12 of the diffuser element 2, defines for the mask 8, in general terms, an engagement zone for the conditioning means of the light beam.

More in detail, the end portion 12 of the diffuser element 2 has a plurality of circumferential sectors 13 emerging radially.

The end portion 12 is preferably made of a metallic material.

The locking mask 8 has a plurality of circumferential radial sectors 14, made at the above-mentioned engagement zone defined by the annular cavity 8*c* inside the outer cylindrical portion 8*b*.

The above-mentioned circumferential sectors 13 and 14 are suitably shaped to engage with each other in a gripping fashion.

In other words, the above-mentioned engaging zone 8*c*, with its circumferential sectors 14, defines, together with the end portion 12 and its circumferential sectors 13 emerging radially, a bayonet coupling designed to guarantee a stable positioning of the diffuser element 2 relative to the sink element 3.

With reference to FIG. 2, in the assembly, a gasket 15 of the elastic ring type is advantageously interposed between the mask 8 and the sink element 3.

The term bayonet coupling means the connection between two parts wherein one part is at least partly inserted in the other and made to rotate to determine a mutual locking condition.

As illustrated in FIGS. 2 and 4, the locking mask 8 supports an element 16 for snap-on fastening of the above-mentioned bayonet coupling.

The snap-on fastening element 16 has a main body 17 with a cylindrical shape, slidably housed inside a respective hole made on the mask 8 at the above-mentioned engaging zone 8*c*.

A recess 18 is formed on the main body 17.

The fastening element 16 also has a helical spring 19.

In use, the fastening element 16 is shaped in such a way as to be able to be pushed radially, from the neutral position towards the axis A1, by a cam, not illustrated, made on the end portion 12 of the diffuser element 2 during its rotation in the step of connecting the above-mentioned bayonet coupling.

When the complete rotation is reached, the main body 17 of the fastening element 16, pushed radially by a spring 19, returns to the neutral position inserting stably in a suitable housing formed in the above-mentioned end portion 12 of the above-mentioned and not illustrated cam.

The mutual rotation of the first part E and second part D of the lamp structure 1 is prevented in the configuration described above.

In order to be able to proceed to the uncoupling of the bayonet, that is, removal of the diffuser element 2 from the heat sink element 3, it is sufficient to press manually, in a radial direction towards the axis A1, the main body 17 of the fastening element 16, overcoming the opposing force exerted by the spring 19, and then rotate the diffuser element 2 in the opposite direction up to the complete extraction from the locking mask 8.

FIGS. 7 to 10 illustrate further examples of means for conditioning the light beam different from the spherical diffuser element 2 and in any case falling within the scope of this invention.

Figure 7:
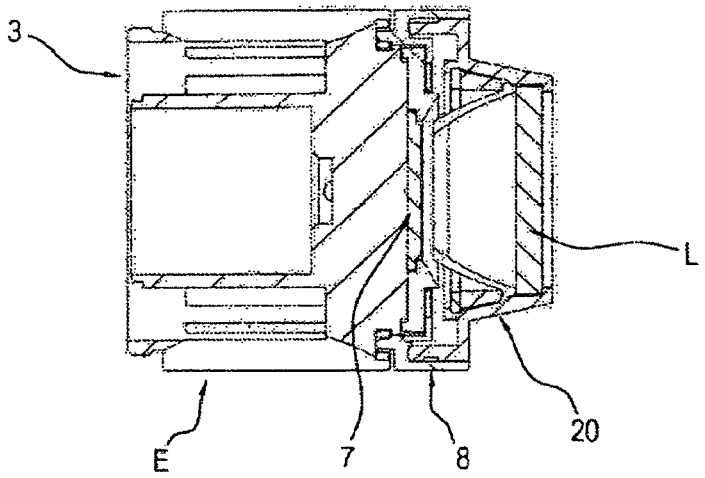
FIGS. 7 to 10 are respective schematic views in cross section of variant embodiments of the modular lamp structure of FIG. 6.

More specifically, FIG. 7 shows a modular lamp structure 1 comprising an element 20 conveying the light beam emitted by the LED source 7, equipped with a lens L.

Figure 8:
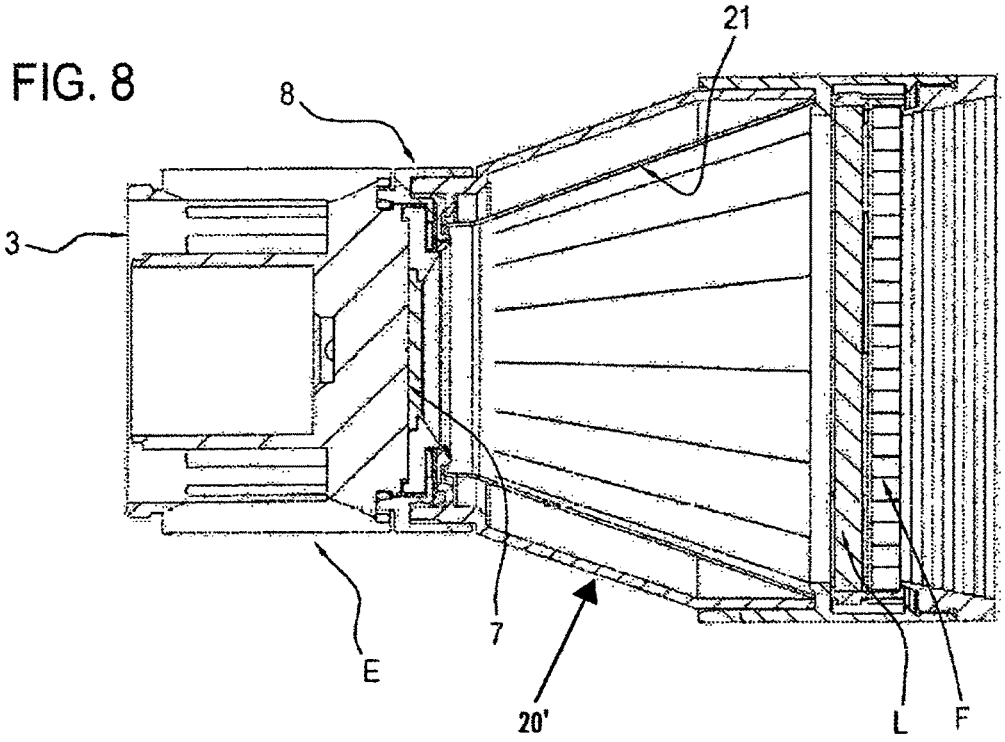
Figure 10:
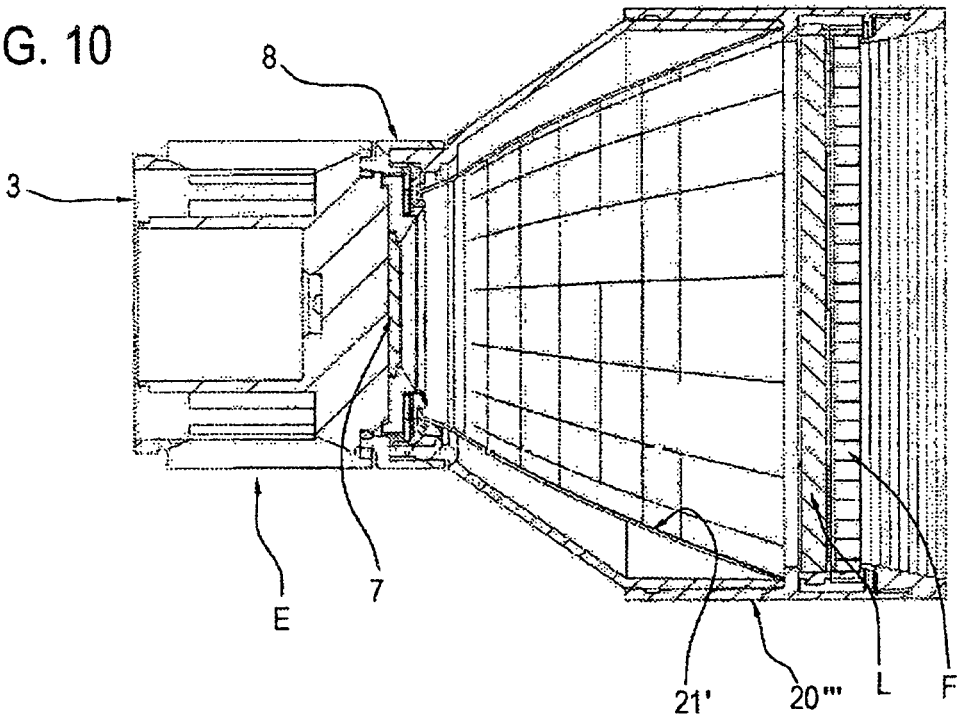

FIGS. 8 and 10 illustrate two further examples of the various conveying elements 20' and 20''', having inside reflective mirrors 21 and 21', respectively conical and parabolic, also equipped with filters F.

Figure 9:
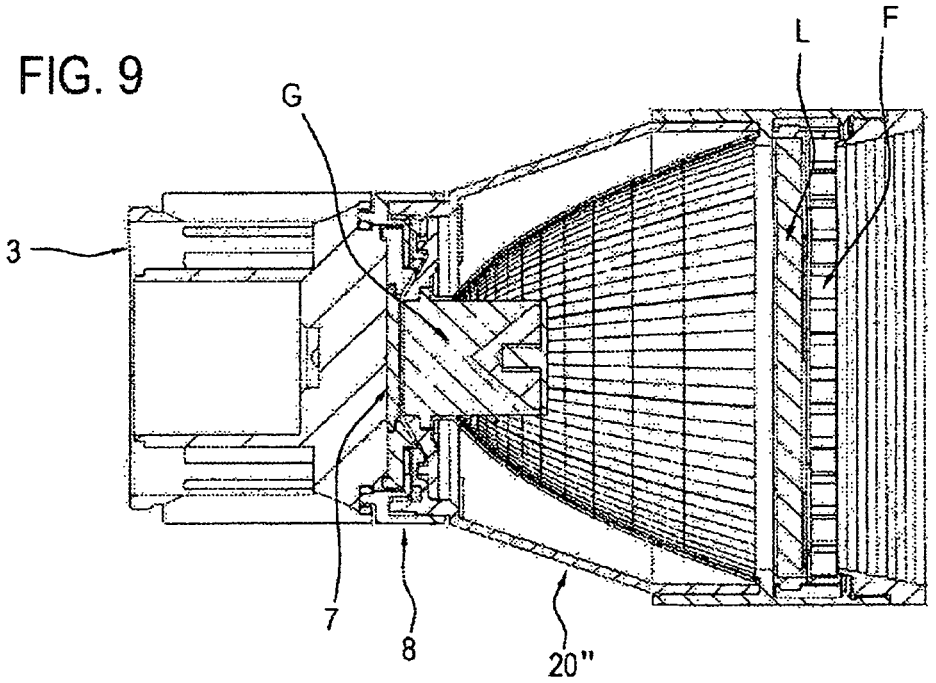

FIG. 9 illustrates an element 20" for conveying the light beam, having a wave guide G.

The invention brings considerable advantages and achieves the preset aims.

The modular LED lamp structure according to the invention allows lighting systems to be assembled in a particularly flexible and versatile manner, since LED lighting sources 7 of very different shapes and sizes may be mounted on the sink element 3, thanks to the use of the interchangeable adapter element 11.

Moreover, the versatility regarding the receiving of different light sources is useful as it enables the fitting of many different means for conditioning the light beam so as to maximize the possibility of making a lighting system most suitable for the particular requirement.

In addition, a further advantage consists in the ease with which, thanks to the removable connections between the various components, it is possible to modify the composition of a lamp structure, both the light source and, if required, also the means for conditioning the light beam. This opportunity not only allows a considerable saving in terms of cost but also of time, as it is possible to rapidly modify an existing lamp structure to adapt it to new different requirements which have arisen.

The invention claimed is:

1. A modular LED lamp structure comprising:

an LED light source, a heat sink element having a flat surface to support the LED light source and a central axis perpendicular to the flat surface, a conditioning device for conditioning a beam of light emitted by the LED light source, the conditioning device including a reflective surface for reflecting the beam of light, a fixing element configured to press the LED light source against the flat surface of the heat sink element, the fixing element including an engaging area for coupling to the conditioning device, a fastening device for removably fastening the fixing element to the heat sink element, wherein the engaging area extends circumferentially inside an outer cylindrical portion of the fixing element to define, together with a matching end portion of the conditioning device, a bayonet coupling to secure the conditioning device to the heat sink element, a snap-on device including a spring biased engagement member for fixing the bayonet coupling;

an interchangeable adapter element interposed between the LED light source and the fixing element to make the fixing element compatible with one of different light sources;

wherein the fixing element and the interchangeable adapter element have respective matching faces configured to engage with each other to define a shape coupling, the shape coupling including an asymmetrical profile to define a single angular coupling orientation relative to the central axis.

2. The modular structure according to claim 1, wherein the fixing element further comprises a central portion for engaging with the adapter element and an outer cylindrical portion enclosing the central portion and configured for dissipating heat generated by the LED light source.

3. The modular structure according to claim 2, wherein a central axis of the outer cylindrical portion extends perpendicular to the flat surface of the heat sink element.

4. A method for substituting an LED light source in a modular lamp structure, comprising:

providing:

a heat sink element having a flat surface for supporting the LED light source and a central axis perpendicular to the flat surface, a fixing element configured to press the LED light source against the flat surface, an Interchangeable adapter element interposed between the LED light source and the fixing element for coupling the fixing element to the LED light source, and a fastening device for removably fastening the fixing element to the heat sink element, freeing the fixing element from the heat sink element by acting on the fastening devices, removing the LED light source to be substituted and the interchangeable adapter element, positioning a different LED light source on the heat sink element, the different LED light source being configured differently from the LED light source, positioning a different adapter element shaped to receive the different LED light source, the different adapter element being configured differently from the interchangeable adapter element, positioning the fixing element on the different adapter element and securing the different adapter element to the heat sink element by acting on the fastening device.

* * * * *